US005598583A

United States Patent [19]

Victor et al.

[11] Patent Number: 5,598,583

[45] Date of Patent: Feb. 4, 1997

[54] BACK SUPPORT BELT COVER

[76] Inventors: Carol J. Victor; Michelle A. Carrara, both of 6 S. Cobblers Ct., Niantic, Conn. 06357

[21] Appl. No.: 393,667

[22] Filed: Feb. 24, 1995

[51] Int. Cl.[6] ..... A41D 13/00; A41D 27/12

[52] U.S. Cl. ..... 2/46; 2/338; 2/312; 297/482; 602/19

[58] Field of Search ..... 2/311, 312, 313, 2/338, 1, 2, 44, 92; 450/86, 155; 297/482; 602/19, 60

[56] References Cited

U.S. PATENT DOCUMENTS

| | | | |
|---|---|---|---|
| 4,326,300 | 4/1982 | Bolton et al. | 2/114 |
| 4,886,318 | 12/1989 | Pennock | 297/482 |
| 5,046,488 | 9/1991 | Schiek, Sr. | 128/78 |
| 5,083,554 | 1/1992 | Toso | 602/19 |
| 5,178,439 | 1/1993 | McCracken | 297/482 |
| 5,215,333 | 6/1993 | Knight | 297/482 X |
| 5,312,159 | 5/1994 | Essa et al. | 297/482 |
| 5,313,669 | 5/1994 | Rasdell et al. | 2/338 X |
| 5,318,507 | 6/1994 | Greengarg | 602/19 |

*Primary Examiner*—Jeanette E. Chapman

[57] ABSTRACT

A cover for enclosing a belt of a back support brace. The inventive device includes an outer cover assembly for coextensively covering an outer rear surface of a lumbar support belt. A securing assembly is extendable about the belt to releasably couple the outer cover assembly thereto so as to protect and improve aesthetic appearance of the belt.

8 Claims, 4 Drawing Sheets

FIG 3
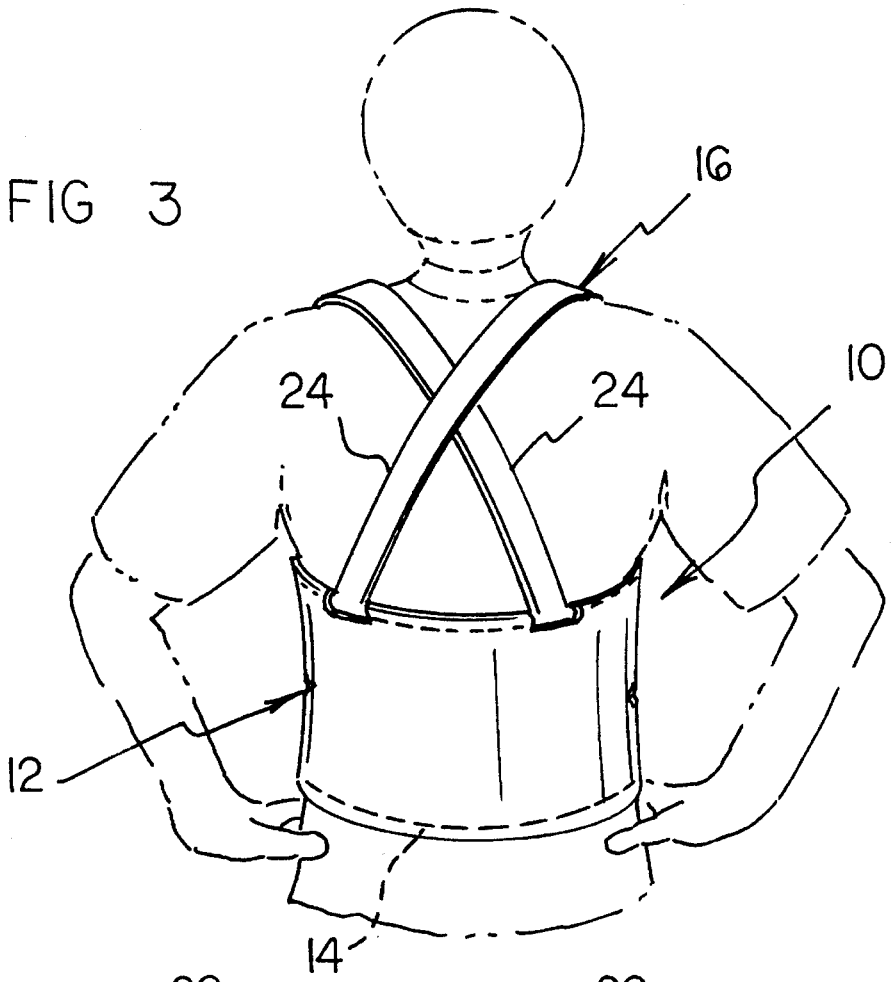
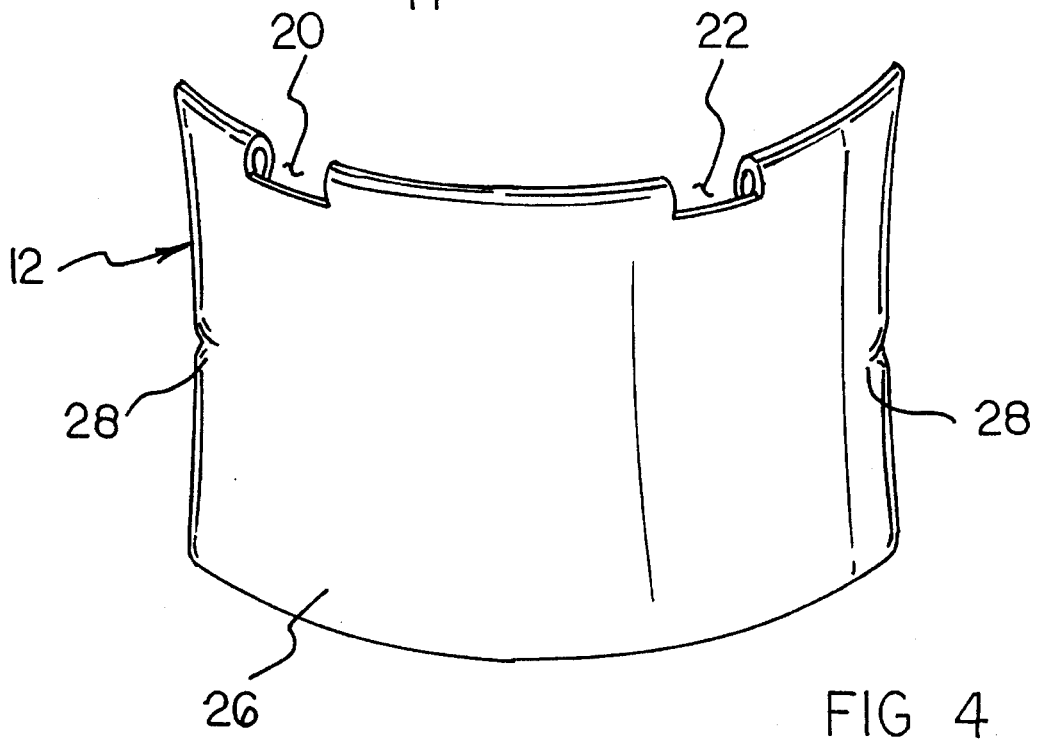
FIG 4

BACK SUPPORT BELT COVER

BACKGROUND OF THE INVENTION

1. Field of the Invention

The present invention relates to covering devices and more particularly pertains to an back support belt cover for enclosing a belt of a back support brace.

2. Description of the Prior Art

The use of covering devices is known in the prior art. More specifically, covering devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art covering devices include U.S. Pat. Nos. 5,228,609; 5,257,419; 5,188,586; 5,111,806; and 4,384,372.

While these devices fulfill their respective, particular objectives and requirements, the aforementioned patents do not disclose a back support belt cover for enclosing a belt of a back support brace which includes an outer cover assembly for coextensively covering an outer rear surface of a lumbar support belt, and a securing assembly extendable about the belt to releasably couple the outer cover assembly thereto so as to protect and improve aesthetic appearance of the belt.

In these respects, the back support belt cover according to the present invention substantially departs from the conventional concepts and designs of the prior art, and in so doing provides an apparatus primarily developed for the purpose of enclosing a belt of a back support brace.

SUMMARY OF THE INVENTION

In view of the foregoing disadvantages inherent in the known types of covering devices now present in the prior art, the present invention provides a new back support belt cover construction wherein the same can be utilized for enclosing a belt of a back support brace. As such, the general purpose of the present invention, which will be described subsequently in greater detail, is to provide a new back support belt cover apparatus and method which has many of the advantages of the covering devices mentioned heretofore and many novel features that result in a back support belt cover which is not anticipated, rendered obvious, suggested, or even implied by any of the prior art covering devices, either alone or in any combination thereof.

To attain this, the present invention generally comprises a cover for enclosing a belt of a back support brace. The inventive device includes an outer cover assembly for coextensively covering an outer rear surface of a lumbar support belt. A securing assembly is extendable about the belt to releasably couple the outer cover assembly thereto so as to protect and improve aesthetic appearance of the belt.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new back support belt cover apparatus and method which has many of the advantages of the covering devices mentioned heretofore and many novel features that result in a back support belt cover which is not anticipated, rendered obvious, suggested, or even implied by any of the prior art covering devices, either alone or in any combination thereof.

It is another object of the present invention to provide a new back support belt cover which may be easily and efficiently manufactured and marketed.

It is a further object of the present invention to provide a new back support belt cover which is of a durable and reliable construction.

An even further object of the present invention is to provide a new back support belt cover which is susceptible of a low cost of manufacture with regard to both materials and labor, and which accordingly is then susceptible of low prices of sale to the consuming public, thereby making such back support belt covers economically available to the buying public.

Still yet another object of the present invention is to provide a new back support belt cover which provides in the apparatuses and methods of the prior art some of the advantages thereof, while simultaneously overcoming some of the disadvantages normally associated therewith.

Still another object of the present invention is to provide a new back support belt cover for enclosing a belt of a back support brace.

Yet another object of the present invention is to provide a new back support belt cover which includes an outer cover assembly for coextensively covering an outer rear surface of a lumbar support belt, and a securing assembly extendable about the belt to releasably couple the outer cover assembly thereto so as to protect and improve aesthetic appearance of the belt.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an isometric illustration of a back support belt according to the invention in use.

FIG. 4 is an isometric illustration of the back support belt cover invention, per se.

DESCRIPTION OF THE PREFERRED EMBODIMENT

Figure 1:
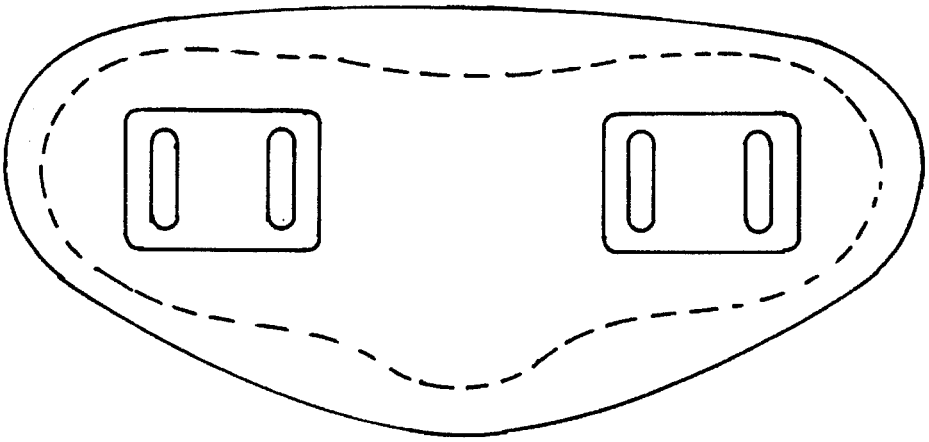
FIG 1 PRIOR ART
FIG. 1 is an elevation view of a prior art back support device.

With reference now to the drawings, and in particular to FIGS. 3–8 thereof, a new back support belt cover embodying the principles and concepts of the present invention and generally designated by the reference numeral 10 will be described.

Figure 2:
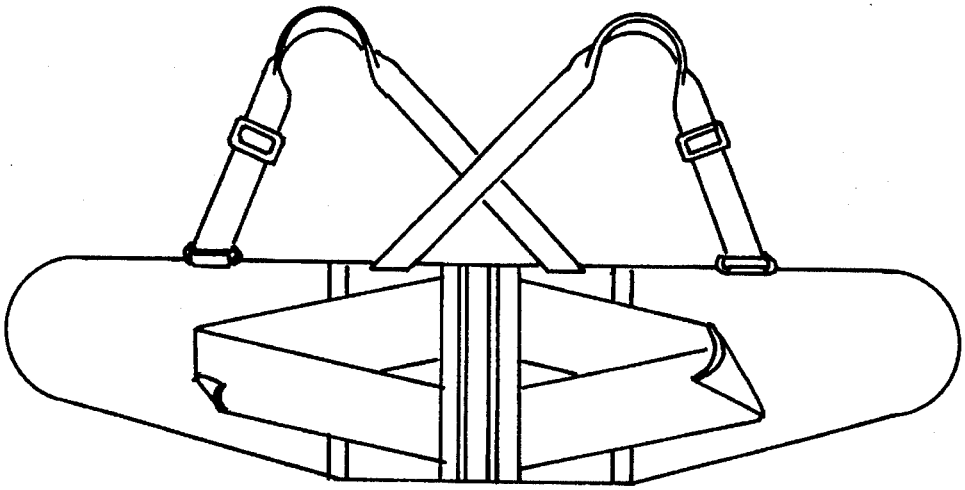
FIG 2 PRIOR ART
FIG. 2 is an elevation view of a further prior art back support device.
Figure 5:
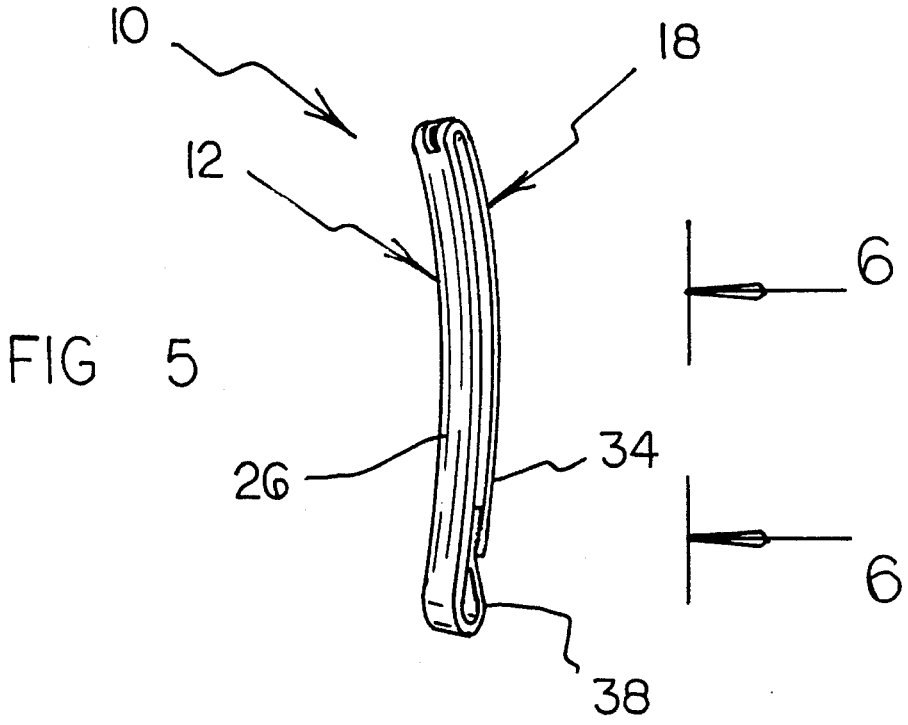
FIG. 5 is a side elevation view of the invention.

Turning initially to FIGS. 1 and 2 of the drawings, it can be shown that prior art back support devices comprise either an attachable belt brace, as shown in FIG. 1, or a waist belt having a pair of shoulder straps extending therefrom as illustrated in FIG. 2.

Figure 6:
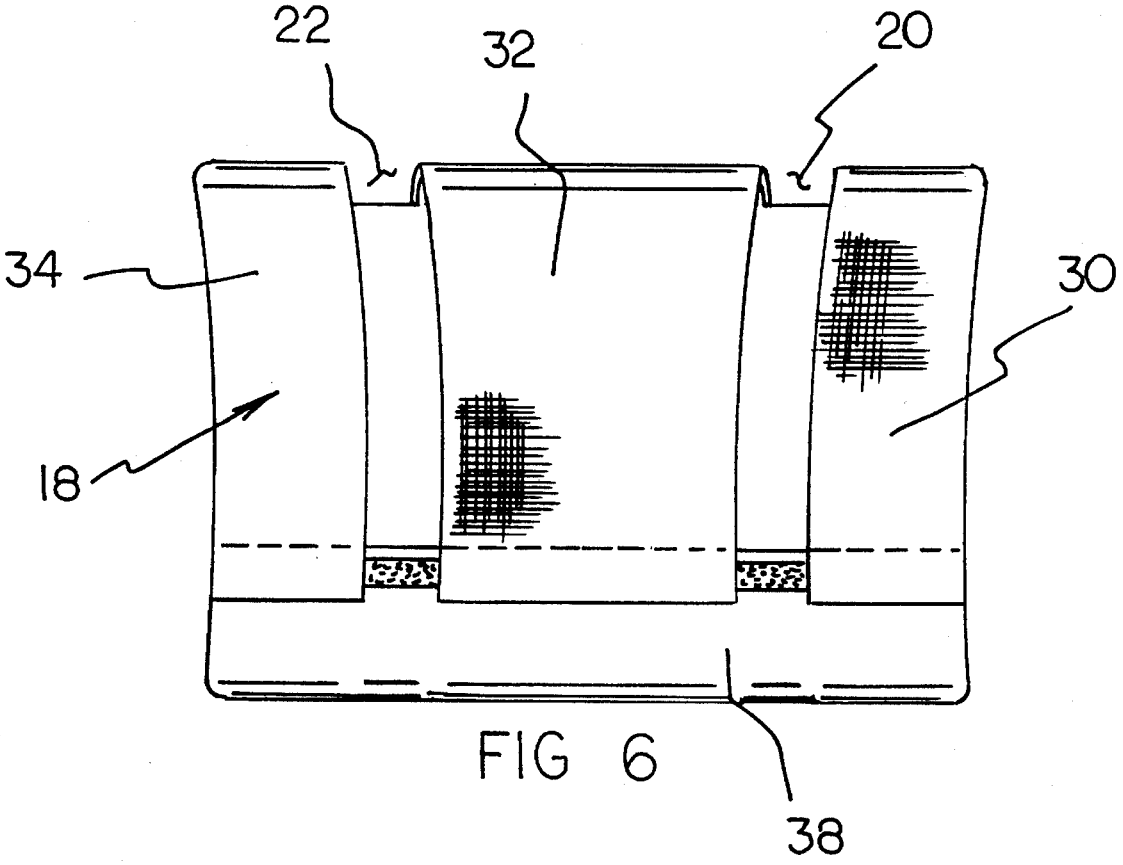
FIG. 6 is a rear elevation view thereof.

Referring now to FIGS. 3 through 8 wherein the present invention 10 illustrated in detail, it can be shown that the present invention substantially departs from the designs of the prior art and comprises an outer cover means 12 for covering a belt 14 of a back support device 16, as shown in FIG. 3 of the drawings. A securing means 18, as shown in FIG. 6, is coupled to the outer cover means 12 for securing the outer cover means relative to the belt 14 of the back support device 16. The securing means 18 includes a first strap slot 20 and a second strap slot 22 permitting passage of shoulder straps 24 of the back support device 16 through the cover 10 when the same is coupled thereto as shown in FIG. 3. By this structure, the back support belt cover according to the present invention can be secured to coextensively cover and protect the belt 14 of the back support device 16.

As best illustrated in FIG. 4, it can be shown that the outer cover means 12 according to the present invention 10 preferably comprises an outer web 26 of substantially rectangular configuration having horizontal pleats 28 directed thereinto along laterally opposed edges. The horizontal pleats 28 are preferably positioned medially between opposed longitudinal edges of the outer web 26. The outer web 26 is comprised of any substantially flexible or flaccid material and may include decorative motifs for ornamental designs printed thereon so as to improve aesthetic appearance of the device 10. By this structure, the belt 14 of the back support device 16 can be covered by the outer cover means 12 so as to protect and improve aesthetic appearance of the belt.

Figure 7:
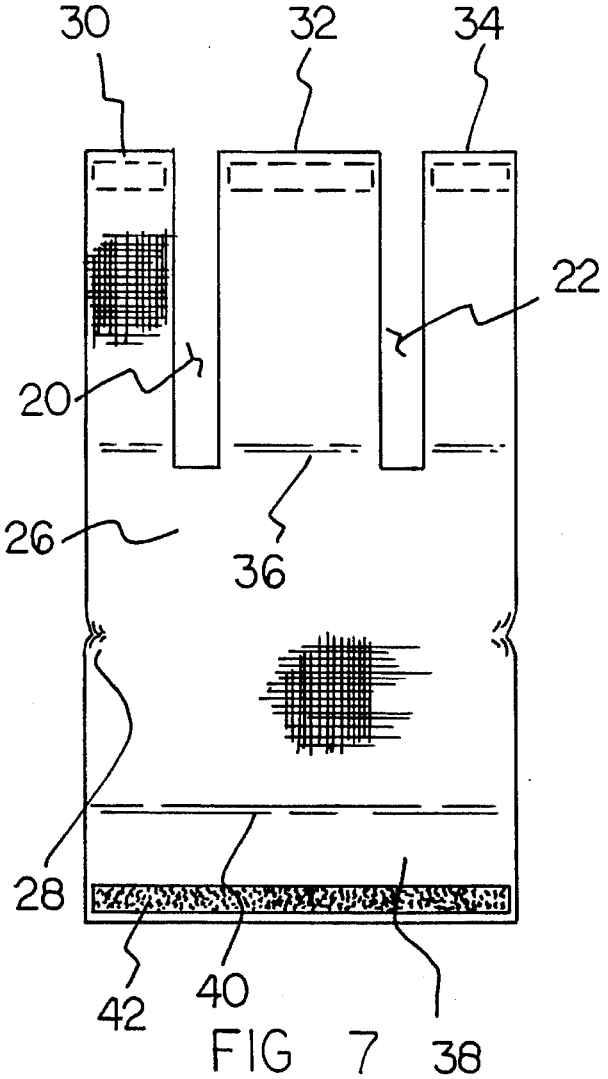
FIG. 7 is a front elevation view of the invention in an unfolded form.
Figure 8:
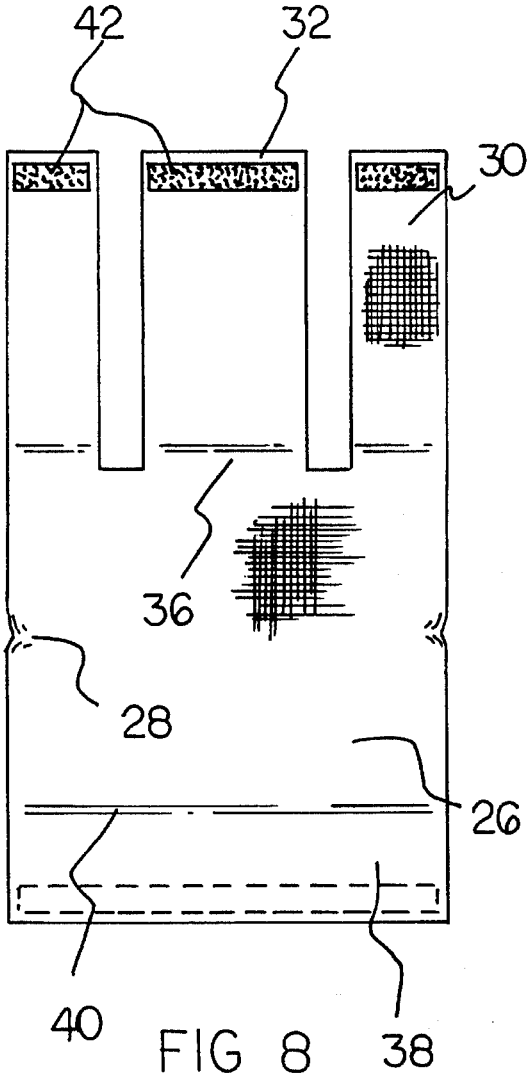
FIG. 8 is a rear elevation view of the invention in the unfolded form.

Referring now to FIGS. 5 through 8, it can be shown that the securing means 18 according to the present invention 10 preferably comprises a first lateral web 30 extending from an upper longitudinal edge of the outer web 26. A medial web 32 similarly extends from the upper longitudinal edge of the outer web 26 and into a substantially spaced and parallel orientation relative to the first lateral web 30 so as to define the first strap slot 20 therebetween. A second lateral web 34 projects from the upper longitudinal edge of the outer web 26 and into a substantially spaced and parallel orientation relative to the medial web 32 so as to define the second strap slot 22 therebetween. Preferably, the lateral webs 30 and 34 include outer lateral edges which extend into contiguous communication with the outer lateral edges of the outer web 26. Further, it is desirable that the outer web 26 be integrally formed with the lateral and medial webs 30–34 from a single sheet of material wherein the strap slots 20 and 22 are cut thereinto. As shown in FIGS. 7 and 8, an upper fold line 36 is defined along the upper longitudinal edge of the outer web 26 and permits the lateral and medial webs 30–34 to be folded into a substantially spaced and parallel orientation relative to the outer web, with the strap slots 20 and 22 permitting projection of the shoulder straps 24 of a back support device 16 exterior of the cover 10.

With continuing reference to FIGS. 5 through 8, it can be shown that the securing means 18 according to the present invention 10 further comprises a securing web 38 extending from a lower longitudinal edge of the outer web 26. The securing web 38 is preferably integrally formed with the outer web 26 and defined relative thereto by a lower fold line 40 permitting folding of the securing web 38 into a substantially spaced and parallel orientation illustrated in FIG. 5 of the drawings. A joining means is coupled to the securing web 38 and to each of the lateral and medial webs 30–34 for coupling the lateral and medial webs to the securing web about the belt 14 of the back support device 16. Preferably, the joining means comprises a fabric fastening material 42, otherwise known as hook and loop material or "VELCRO" material, which is coupled to the securing web 38 and the lateral and medial webs 30–34 and cooperable to secure the lateral and medial webs to the securing web 38 about the belt 14 as described above. By this structure, the securing means 18 permits selective securement of the outer cover means 12 to the belt 14 to protect and improve appearance of the belt.

In use, the back support belt cover 10 according to the present invention can be easily coupled to a belt 14 of a back support device 16 so as to protect and improve aesthetic appearance of the belt 14. If desired, indica or other ornamental designs can be printed on the outer web 26.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A back support belt cover comprising:

an outer cover web of substantially rectangular configuration having horizontal pleats positioned medially between horizontal longitudinal edges of said web and directed thereinto along laterally opposed edges, said web being coextensive with and covering the entire belt of a back support device wherein said back support device is adapted to extend horizontally about and to enclose the torso portion of a wearer at the waist thereof;

and a securing means coupled to the outer cover web for securing the outer cover web to the belt of the back support device, said securing means comprising a first lateral web extending from and integral with the upper longitudinal edge of the outer cover web, a medial lateral web extending from and integral with said upper longitudinal edge of said outer web and into a spaced and parallel orientation to said first lateral web so as to define a first vertically opening strap slot therebetween, a third lateral web extending from and integral with said upper longitudinal edge of said outer web into a spaced and parallel orientation to said medial web so as to define a second vertically opening strap slot therebetween, a horizontally extending securing web extending from and integral with the lower longitudinal edge of said outer web and a joining means coupled to the securing web and to each of the lateral and medial webs for adjustably coupling said webs to said securing web about the belt of the back support device.

2. The back support belt cover of claim 1, wherein the joining means comprises a fabric fastening material coupled to the securing web and the lateral and medial webs to secure the lateral and medial webs to the securing web about the belt.

3. The back support belt cover of claim 2, wherein the securing web is integrally formed with the outer web and defined relative thereto by a lower fold line permitting folding of the securing web into a substantially spaced and parallel orientation relative to the outer web.

4. The back support belt cover of claim 3, wherein the lateral webs include outer lateral edges which extend into contiguous communication with the outer lateral edges of the outer web.

5. The back support belt cover of claim 4, wherein the outer web is integrally formed with the lateral and medial webs from a single sheet of material wherein the strap slots are cut thereinto.

6. The back support belt cover of claim 5, wherein an upper fold line is defined along the upper longitudinal edge of the outer web and permits the lateral and medial webs to be folded into a substantially spaced and parallel orientation relative to the outer web.

7. The back support belt cover of claim 6, wherein the outer cover means comprises an outer web of substantially rectangular configuration having horizontal pleats directed thereinto along laterally opposed edges.

8. The back support belt cover of claim 7, wherein the horizontal pleats are positioned medially between opposed longitudinal edges of the outer web.

* * * * *